US009742119B2

(12) United States Patent
Fan et al.

(10) Patent No.: US 9,742,119 B2
(45) Date of Patent: Aug. 22, 2017

(54) PLUG CONNECTOR ASSEMBLY WITH SHIELDING SHELL

(71) Applicant: FOXCONN INTERCONNECT TECHNOLOGY LIMITED, Grand Cayman (KY)

(72) Inventors: Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/080,610

(22) Filed: Mar. 25, 2016

(65) Prior Publication Data

US 2016/0285206 A1 Sep. 29, 2016

(30) Foreign Application Priority Data

Mar. 25, 2015 (CN) ..... 2015 1 0131649

(51) Int. Cl.
*H01R 9/03* (2006.01)
*H01R 13/6581* (2011.01)
(Continued)

(52) U.S. Cl.
CPC ..... *H01R 13/6581* (2013.01); *H01R 13/6593* (2013.01); *H01R 24/60* (2013.01);
(Continued)

(58) Field of Classification Search
CPC ..... H01R 13/6581
(Continued)

(56) References Cited

U.S. PATENT DOCUMENTS 6,179,662 B1 * 1/2001 Kuo ..... H01R 13/65802 439/607.53
6,699,075 B1 * 3/2004 Ko ..... H01R 9/032 439/607.48

(Continued)

FOREIGN PATENT DOCUMENTS

CN 101132091 A 2/2008
CN 201252224 Y 6/2009
CN 203645024 U 6/2014

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

A plug connector assembly includes a bottom metallic shell having a lower wall, a front wall, a rear wall, a left wall, and a right wall, and defining a receiving slot. The front wall has an inserting groove extending therethrough along a front-to-back direction and a mounting slit extending downwardly from a top edge of the front wall and communicating to the inserting groove. A top metallic shell assembled to the bottom metallic shell along a top-to-bottom direction has a plurality of side walls, an opening defined by the side walls, and a front wall extending downwardly from of the side walls and abutting against the front wall of the bottom metallic shell to seal the mounting slit. A printed circuit board (PCB) is located in the receiving slot and enclosed by the bottom and top shells. A connector connects with a top section of the PCB.

19 Claims, 10 Drawing Sheets

(51) Int. Cl.

| | |
|---|---|
| ***H01R 13/6593*** | (2011.01) |
| ***H01R 24/60*** | (2011.01) |
| *H01R 12/53* | (2011.01) |
| *H01R 13/58* | (2006.01) |
| *H01R 13/659* | (2011.01) |
| *H01R 13/6596* | (2011.01) |

(52) U.S. Cl.
CPC ..... *H01R 12/53* (2013.01); *H01R 13/5845* (2013.01); *H01R 13/659* (2013.01); *H01R 13/6596* (2013.01); *H01R 2201/06* (2013.01)

(58) Field of Classification Search
USPC ..... 439/607.55, 607.02, 521, 620.15
See application file for complete search history.

(56) References Cited

U.S. PATENT DOCUMENTS 6,755,690 B1 * 6/2004 Zhang ..... H01R 23/6873 439/607.02
6,811,438 B1 * 11/2004 Ko ..... H01R 9/032 439/607.41
6,966,797 B2 * 11/2005 Ko ..... H01R 13/65802 439/607.42
7,165,996 B1 * 1/2007 Kao ..... H01R 13/6593 439/607.55
7,314,386 B2 * 1/2008 Kao ..... H01R 13/6581 439/607.27
7,540,773 B2 * 6/2009 Ko ..... H01R 13/5808 439/581
7,563,108 B1 * 7/2009 Wu ..... H01R 12/592 439/76.1
7,690,948 B2 * 4/2010 Lung ..... H01R 13/41 439/607.27
7,771,236 B2 * 8/2010 Koyama ..... H01R 13/6275 439/607.53
7,798,821 B2 * 9/2010 Liu ..... H01R 9/034 439/459
8,011,960 B2 9/2011 Xiao et al.
8,535,088 B2 9/2013 Gao et al.
8,562,378 B2 * 10/2013 Su ..... H01R 13/502 439/607.55
8,568,172 B1 * 10/2013 Lan ..... H01R 12/57 439/607.4
9,017,091 B2 * 4/2015 Zhu ..... H01R 13/512 439/352
9,017,092 B1 4/2015 McCracken et al.
9,166,342 B1 * 10/2015 Tao ..... H01R 13/6581
9,178,316 B1 * 11/2015 McCracken ..... H01R 13/62
9,455,535 B1 * 9/2016 Chiang ..... H01R 13/6585
2005/0272303 A1 * 12/2005 Wu ..... H01R 9/03 439/499
2008/0050963 A1 * 2/2008 Shi ..... H01R 13/506 439/364
2010/0151743 A1 * 6/2010 Zhou ..... H01R 9/03 439/651
2011/0263141 A1 * 10/2011 Ko ..... H01R 12/707 439/83
2014/0073193 A1 3/2014 SooHoo et al.
2015/0037986 A1 2/2015 Wu et al.
2015/0214670 A1 7/2015 Di et al.
2015/0214677 A1 7/2015 Huang et al.
2015/0288107 A1 10/2015 Wu et al.
2016/0028188 A1 * 1/2016 Dunwoody ..... H01R 13/6581 439/607.55
2016/0268741 A1 * 9/2016 Tsai ..... H01R 13/6585

* cited by examiner

PLUG CONNECTOR ASSEMBLY WITH SHIELDING SHELL

BACKGROUND OF THE INVENTION

1. Field of the Invention

The present invention relates to a plug connector assembly, and more particularly to a plug connector assembly equipped with a shielding shell to reduce EMI.

2. Description of Related Arts

U.S. Patent Application Publication No. 2014/0073193 discloses a plug connector that can be incorporated into electronic devices and docking stations.

U.S. Pat. No. 9,017,092 discloses a plug connector having a tapered extension that projects outward along a connection axis, and a corresponding receptacle connector having a receptacle that accommodates the tapered extension. The plug connector includes one or more electrically conductive wires for transmitting electrical power, electrical signals, and/or a ground reference.

U.S. Patent Application Publication No. 2015/0214677 discloses a plug connector assembly including a mating connector extending along a bottom-to-top direction, a printed circuit board connecting with a bottom side of the mating connector, and an insulative housing enclosing the printed circuit board and a part of the mating connector. The printed circuit board is provided with a number of electrical components which may cause electromagnetic interference (EMI) with exterior electrical devices.

Therefore, a plug connector assembly with shielding shell to reduce EMI is desired.

SUMMARY OF THE INVENTION

Accordingly, an object of the present invention is to provide a plug connector assembly including a bottom metallic shell having a lower wall, a front wall, a rear wall, a left wall, and a right wall, and defining a receiving slot. The front wall has a first inserting groove extending therethrough along a front-to-back direction and a first mounting slit extending downwardly from a top edge of the front wall and communicating to the first inserting groove. A top metallic shell assembled to the bottom metallic shell along a top-to-bottom direction has a plurality of side walls, an opening defined by the side walls, and a front wall extending downwardly from one of the side walls and abutting against the front wall of the bottom metallic shell to seal the first mounting slit. The front wall of the top metallic shell forms a third inserting groove recessed upwardly from a bottom edge thereof. The third inserting groove cooperates with the first inserting groove to define a first hole along the front-to-back direction. A printed circuit board (PCB) is located in the receiving slot and enclosed by the bottom and top metallic shells. A connector connecting with the PCB has a top end extending upwardly through the opening. A first cable extends through the first hole along the front-to-back direction and connects with the PCB. The first cable is mounted, across the first mounting slit along the top-to-bottom direction before the top metallic shell is assembled to the bottom metallic shell, to the first inserting groove.

The PCB is received in the receiving chamber so that the metallic shells reduce EMI between the exterior device and the PCB. The top metallic shell and the bottom metallic shell form a closed hole for passing the first cable and seal the first mounting slit along the front-to-back direction to prevent leakage of electromagnetic noise therefrom.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to some preferred embodiments of the present invention.

Figure 1:
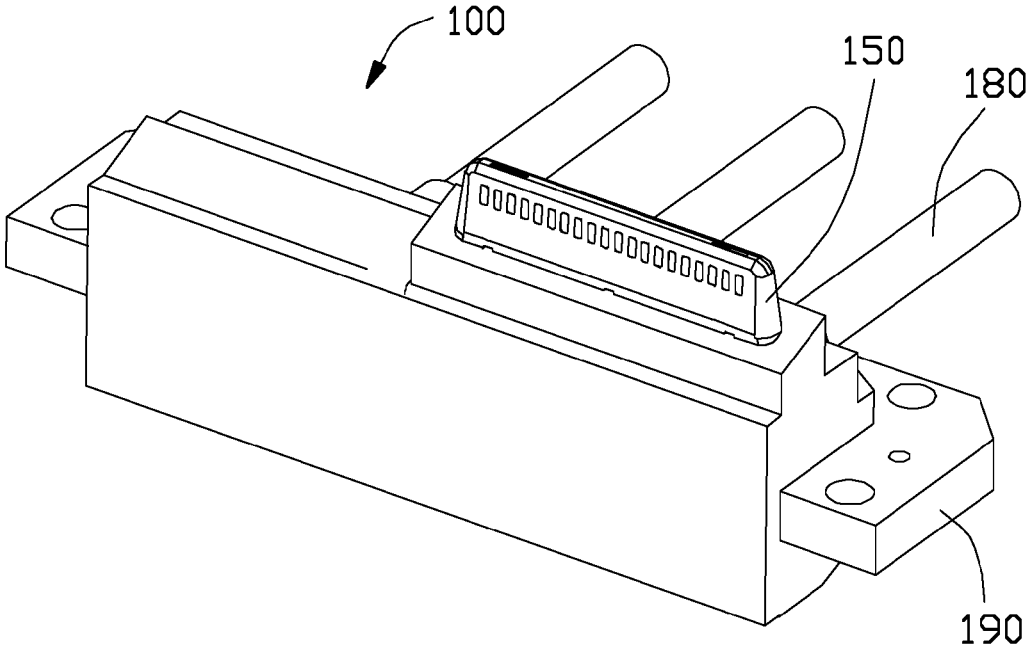
FIG. 1 is a front perspective view of a plug connector assembly in accordance with the present invention.
Figure 2:
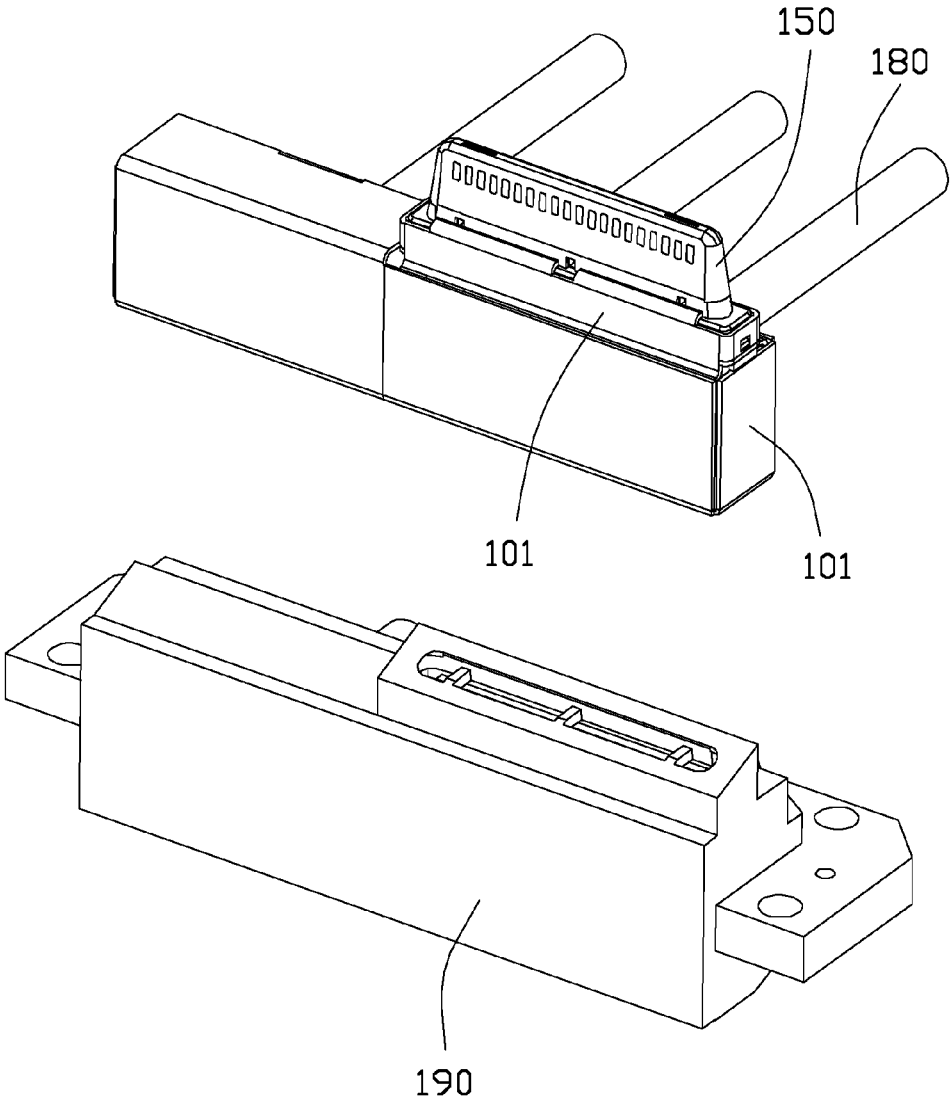
FIG. 2 is a front exploded view of the plug connector assembly as shown in FIG. 1.
Figure 3:
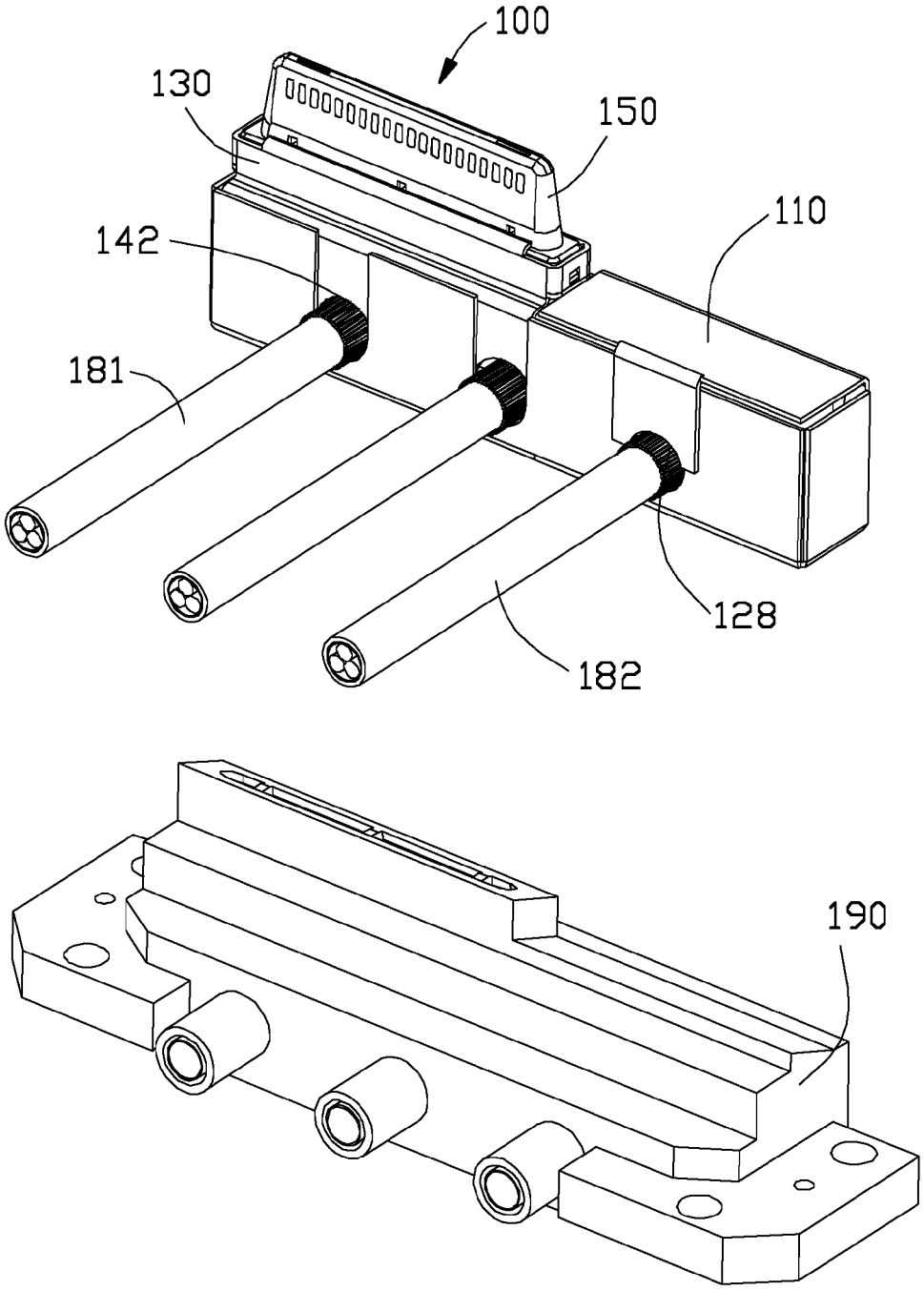
FIG. 3 is a rear exploded view of the plug connector assembly as shown in FIG. 2.
Figure 4:
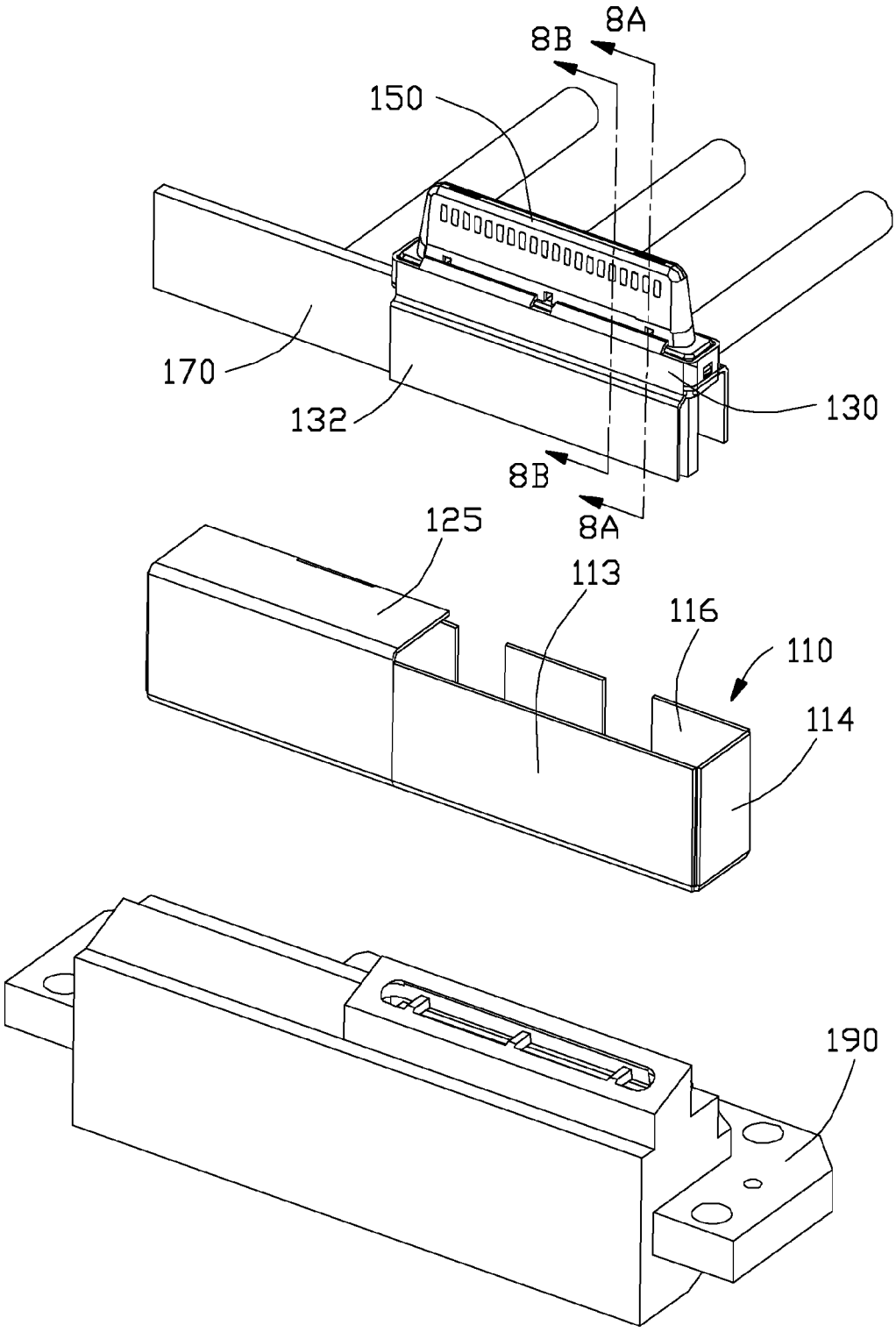
FIG. 4 is a further front exploded view of the plug connector assembly as shown in FIG. 2.
Figure 5:
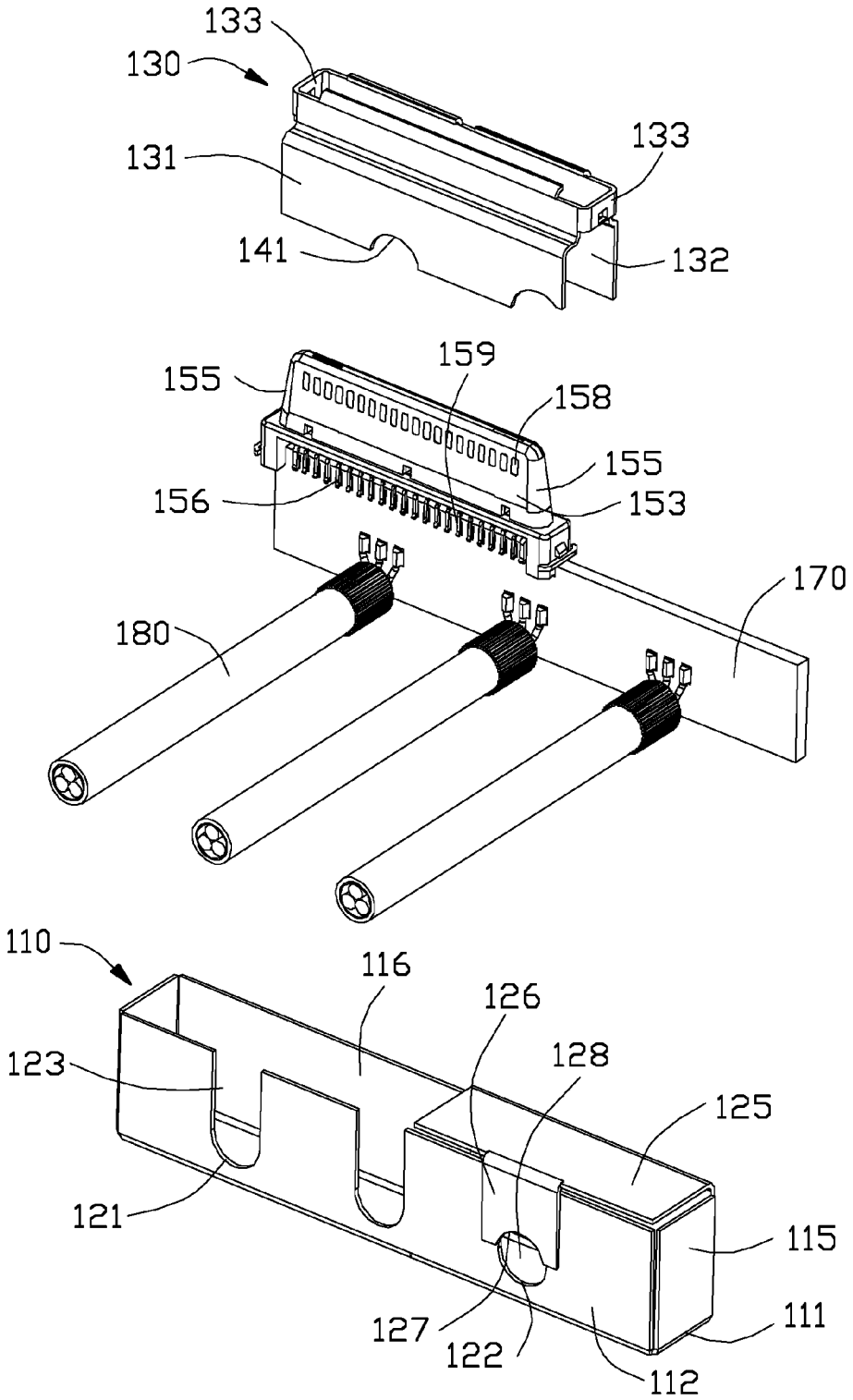
FIG. 5 is a further rear exploded view of the plug connector assembly as shown in FIG. 3, with an insulative case thereof being removed.
Figure 6:
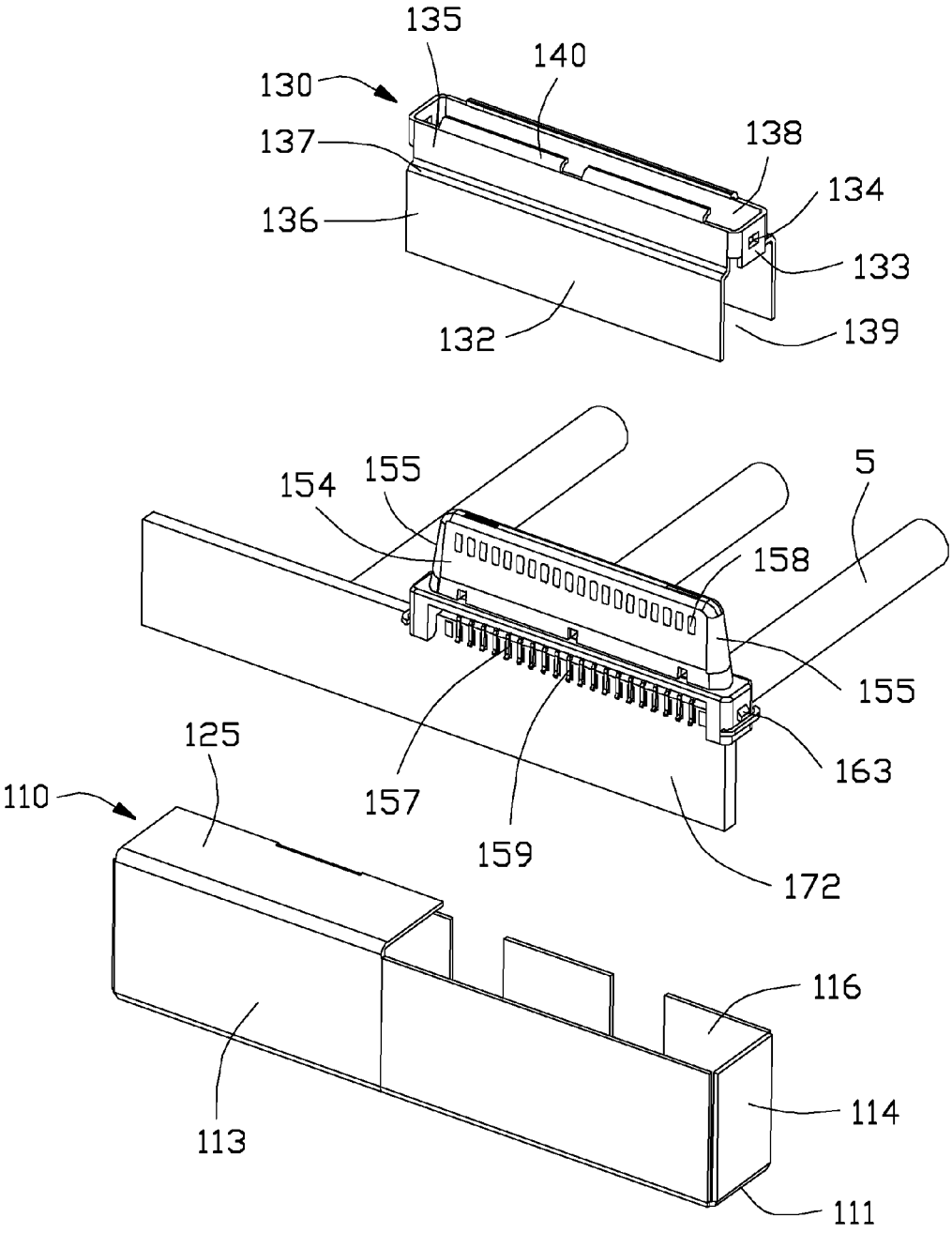
FIG. 6 is a further front exploded view of the plug connector assembly as shown in FIG. 4, with an insulative case thereof being removed.
Figure 7:
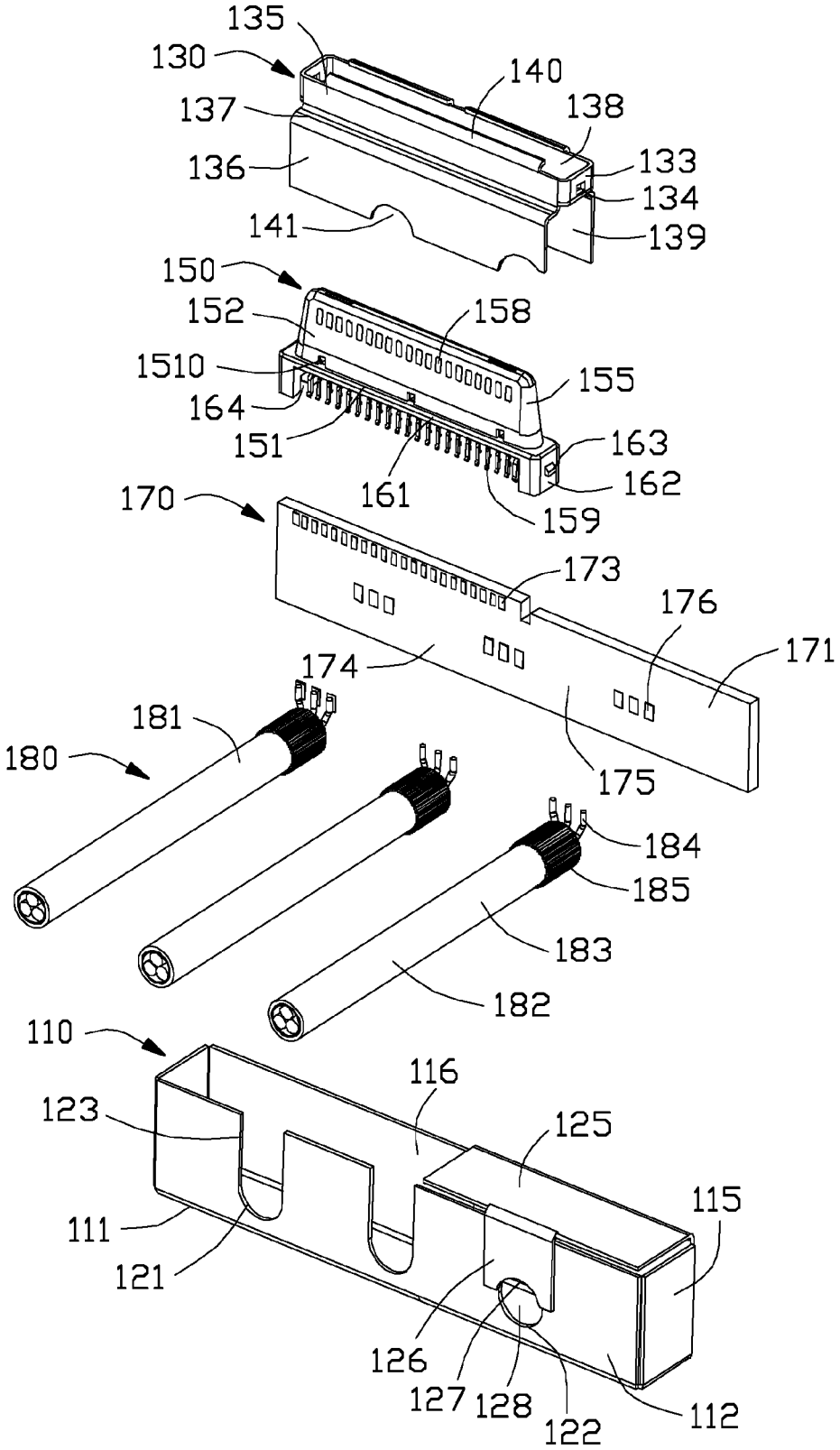
FIG. 7 is a further rear exploded view of the plug connector assembly as shown in FIG. 5.
Figure 8A:
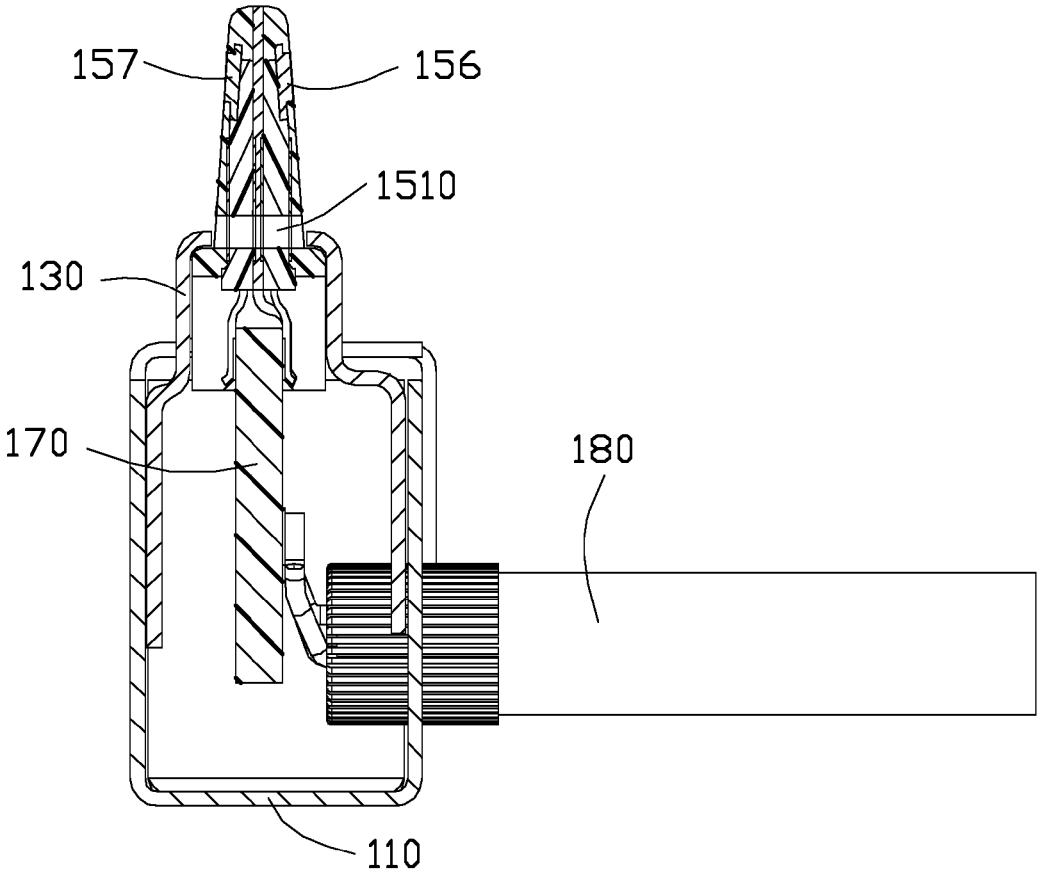
FIG. 8(A) is a cross-sectional view of the connector of FIG. 1 without the insulative case therein along line 8(A)-8(A).
Figure 8B:
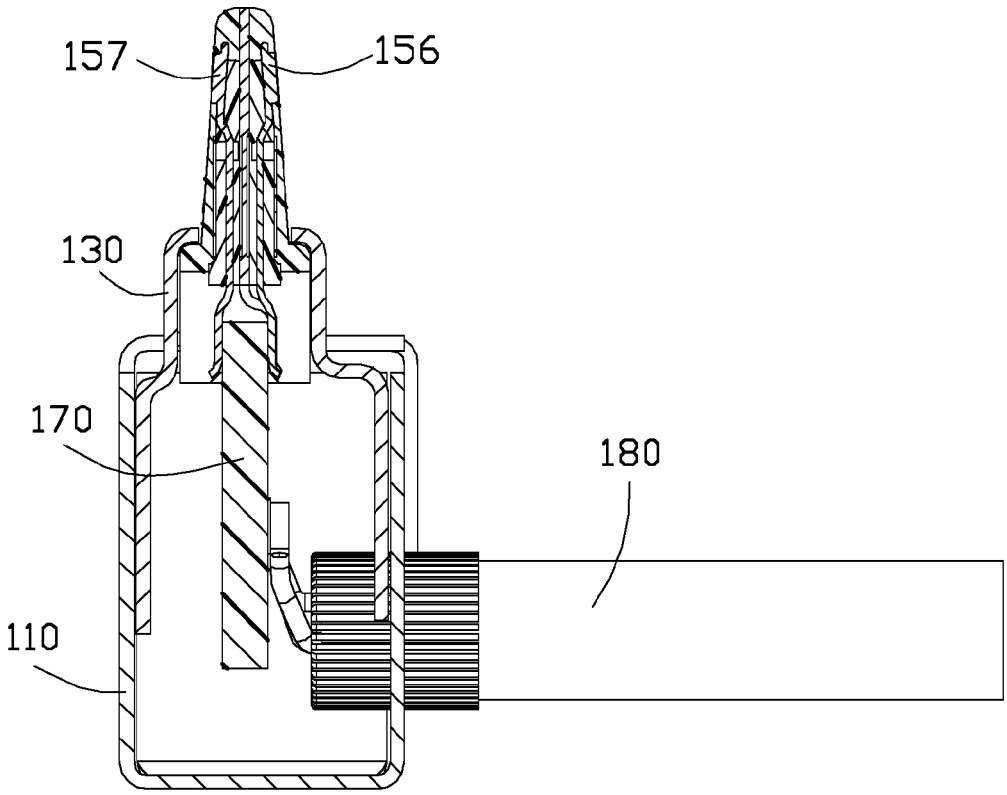
FIG. 8(B) is a cross-sectional view of the connector of FIG. 1 without the insulative case therein along line 8(B)-8(B).
Figure 9:
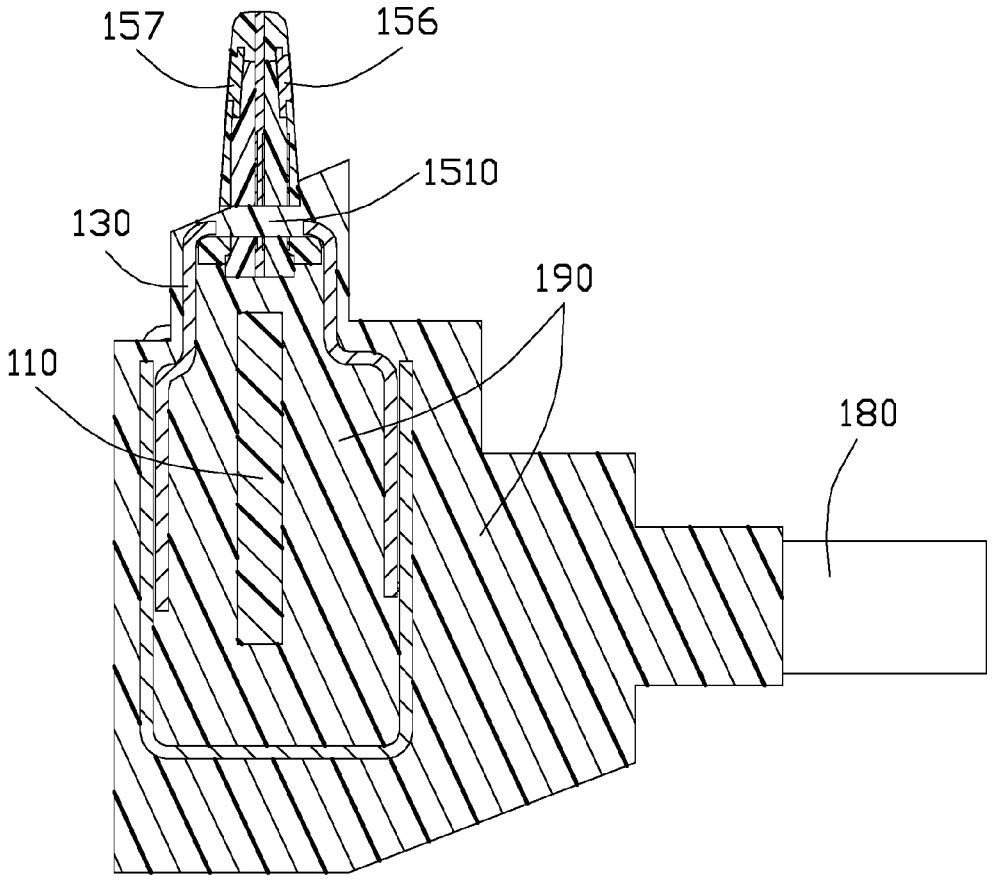
FIG. 9 is a cross-sectional view of the connector of FIG. 1 with the insulative case therein along line 8(A)-8(A).

Referring to FIGS. 1 to 7, a plug connector assembly 100 for mating with a receptacle connector (not shown) in two directions. The plug connector assembly 100 can be incorporated into electronic devices and docking stations.

The plug connector assembly 100 includes a metallic shell 101 having a bottom shell 110 and a top shell 130 assembled thereto.

The bottom shell 110 has a lower wall 111, a front wall 112, a rear wall 113, a left wall 114, a right wall 115, and a receiving slot 116 surrounded by these walls. The front wall 112 defines a plurality of inserting grooves extending therethrough along a front-to-back direction and a plurality of mounting slits extending downwardly from a top edge of the front wall 112 and communicating to the corresponding inserting grooves, respectively. The inserting grooves include a first inserting groove 121 located at a left region of the front wall 112, and a second inserting groove 122 located at a right region of the front wall 112. The mounting slits include a first mounting slit 123 and a second mounting slit corresponding to the first and second inserting grooves 121, 122. A top wall 125 bends from a right top edge of the rear wall 113 and extends forwardly to reach the front wall 112. The top wall 125 is parallel to the lower wall 111 and perpendicular to the front wall 112 and the rear wall 113. An enclosing wall 126 abutting against the front wall 112 bends and extends downwardly from the top wall 125. The enclosing wall 126 seals the second mounting slit along the front-to-back direction to prevent leakage of electromagnetic noise therefrom. The enclosing wall 126 forms a fourth inserting groove 127 recessed upwardly from a bottom edge thereof and cooperating with the second inserting groove 122 to define a second circular (insertion) hole 128 along the front-to-rear direction. Each of the second inserting groove 122 and the fourth inserting groove 127 is a half circular hole.

The top shell 130 cooperates with the front wall 112 of the bottom shell 110 to prevent electromagnetic noise leaking from the first mounting slit 123. The top shell 130 includes a front wall 131 abutting against the front wall 112 and sealing the first mounting slit 12 along the front-to-back direction, a rear wall 132 parallel to the front wall 131 and abutting against the rear wall 113, and two lateral walls 133 connecting between the front and rear walls 131, 132. One lateral wall 133 is disposed intimately to the left wall 114, and the other lateral wall 133 is disposed intimately to the top wall 125. Each of the lateral wall 133 forms a locking hole 134 extending therethrough along a transverse direction (left-to-right direction). Each of the front and rear walls 131, 132 includes a first plate 135, a second plate 136 below the first plate 135 and in front of the first plate 135, and an inclined rib 137 connecting between the first and second plates 134, 135. An opening 138 is surrounded by the first plates 135 and lateral walls 133. There is a receiving room 139 defined by the second plates 136. A block board 140 extends upwardly and inwardly from the top edge of the first plate 135 toward the opening 138. The second plate 136 of the front wall 131 forms a third inserting groove 141 recessed upwardly from a bottom edge thereof. The third inserting groove 141 cooperates with the first inserting groove 121 to define a first circular (insertion) hole 142 along the front-to-back direction. Each of the first and third inserting grooves 121, 141 is a half circular hole.

A connector 150 partly received within the shell 101 includes a base 151 located within the opening 138 and the receiving room 39. A tongue 152 protrudes upwardly from the base 151 and extends out of the top shell 130. A front connection face 153 and a rear connection face 154 taper toward each other from the base 151 to the tongue 152 symmetrically about a first symmetry plane. Two flank faces 155 are formed respective opposing sides of the tapered extension between the front and rear connection faces 153, 154, and tapers toward each other from the base 151 to the tongue 152 symmetrically about a second symmetry plane that is orthogonal to the first symmetry plane. A set of first contacts 156 and a set of second contacts 157 extending along the front connection face 153 and the rear connection face 154, respectively. Each of the first and second contacts 156, 157 has a contacting portion 158 exposed on one of the front and rear connection faces, a tail portion 159 extending downwardly and out of the base 151, and a middle portion buried in tongue 152. The base 151 includes a body 161 extending along the transverse direction and two wings 162 extending downwardly from two lateral sides of the body 161. The tails 159 of the contacts located between the two wings 162. Each wing 162 has a locking protrusion 163 extending far away the tails 159 and a holding slot 164 recessed upwardly from a bottom edge thereof.

A printed circuit board (PCB) 170 received in the receiving slot has a top edge mounted within holding slot 164 and a number of electrical components mounted thereon. The PCB and electrical components could bring electromagnetic noise and interference with exterior electrical components. The PCB 170 has a front surface 171 with conductive pads 173 connecting to the tails 159 of the first contacts 156, and a rear surface 172 with conductive pads connecting to the tails 159 of the second contacts 157. The PCB 170 is longer than the connector 150 along the transverse direction. The PCB 170 has a left part 174 connecting with the connector 150 and a right part 175.

A plurality of cables 180 extend perpendicular to the PCB 170 and connect to the front surface 171 of the PCB 170. The cables 180 include a first cable 181 going through the first circular hole 142 and connecting with the left part 174, and a second cable 182 going through the second circular hole 128 and connecting with the right part 175. Each of the cables 180 includes a cylindrical sleeve 183, a plurality of conductive wires 184 received within the cylindrical sleeve 183, and a weave layer 185 reversing backwardly from the front side thereof. The weave layers 185 are received in the first and second circular holes 142, 128, respectively. The weave layers 185 are mechanically and electrically connected with front wall 112 of the bottom shell 110 to electrically connect an exterior ground.

An insulative case 190 not only encloses the metallic shell 101 and a part of the connector 130 therein but also fills space between the PCB 170 and the shells 110 and 130 and the holes 1510 of the base 151.

The step of assembling the plug connector assembly 100 will be described as follow. Firstly, the PCB 170 is mounted to the connector 150 wherein the tails 159 are soldered to the front and rear surface 171, 172, respectively. Secondly, the front portion of cylindrical sleeve 183 is removed, the front portions of the conductive wires 184 are exposed forwardly, and the weave layers 185 are reversed backwardly. Thirdly, the cables 180 are soldered to the PCB 170 wherein the conductive wires 184 are soldered to the conductive pads 176 of PCB 170. Fourthly, the top shell 130 is assembled to the connector 150 as a hybrid assembly wherein the weave layers 185 of the first cable 181 received within the third inserting groove 141, and the locking protrusions 163 are mounted into the locking holes 133, respectively. Fifthly, the hybrid assembly is assembled to the bottom shell 110 wherein the PCB 170 is received in the receiving slot 116, the first cable 181 is mounted into the first inserting groove 121 across the first mounting slit 123, and the second cable 182 is mounted into the second inserting groove 122 across the second mounting slit. Sixthly, the top wall 125 is bended forwardly and downwardly to reach the front wall 112, after that the enclosing wall 126 is bended backwardly and downwardly from the top wall 125 to abut against the front wall 112. Finally, the insulative case 190 is over molded to the connector 150 and the metallic shell 101 to form the plug connector assembly 100.

Understandably, in this embodiment the so-called bottom shell and top shell are defined according to their current orientations. Anyhow, the connector 150 may be placed horizontally alternately. In brief, the detailed structures of the connector 150 may be similar to that disclosed in U.S. Pat. No. 9,257,801 while the spirit of the invention includes the connector is oriented in a first direction while the cable is orientated in a second direction perpendicular to the first direction and is connected to the connector via a printed circuit board wherein the printed circuit board is preferably positioned to extend in a plane perpendicular to the cable, the metallic shell essentially fully circumferentially encloses the printed circuit board and is composed of opposite first and second shell pieces (i.e., the top shell and the bottom shell), assembled to each other in the first direction, and the inserting groove of the cable is commonly formed by the first shell piece and the second shell piece to fully surround the weave layers of the cable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector assembly comprising:

a bottom metallic shell having a lower wall, a front wall, a rear wall, a left wall, and a right wall and defining a receiving slot, the front wall having a first inserting groove extending therethrough along a front-to-back direction and a first mounting slit extending downwardly from a top edge of the front wall and communicating to the first inserting groove;

a top metallic shell assembled to the bottom metallic shell along a top-to-bottom direction, the top metallic shell having a plurality of side walls, an opening defined by the side walls, and a front wall extending downwardly from one of the side walls and abutting against the front wall of the bottom metallic shell to seal the first mounting slit, the front wall of the top metallic shell forming a third inserting groove recessed upwardly from a bottom edge thereof, the third inserting groove cooperating with the first inserting groove to define a first hole along the front-to-back direction;

a printed circuit board (PCB) located in the receiving slot and enclosed by the bottom and top metallic shells;

a connector connecting with the PCB and having a top end extending upwardly through the opening; and a first cable extending through the first hole along the front-to-back direction and connected with the PCB, the first cable mounted, across the first mounting slit along the top-to-bottom direction before the top metallic shell is assembled to the bottom metallic shell, to the first inserting groove;

wherein the bottom metallic shell has a top wall extending forwardly from the rear wall to the front wall and located above the PCB.

2. The plug connector assembly as recited in claim 1, wherein the first cable includes a weave layer reversing backwardly and received within the first hole to mechanically and electrically connect with the bottom metallic shell to electrically connect to an exterior ground.

3. The plug connector assembly as recited in claim 1, wherein the PCB is longer than the connector along a transverse direction perpendicular to the top-to-bottom direction and the front-to-rear direction, and the PCB has a left part connecting with the connector and a right part.

4. The plug connector assembly as recited in claim 3, further comprising a second cable connected with the right part, and wherein the front wall of the bottom metallic shell has a second inserting groove located at the right side of the first inserting groove and a second mounting slit communicating with the second inserting groove along the top-to-bottom direction, the second cable mounted to the second inserting groove across the second mounting slit along the top-to-bottom direction.

5. The plug connector assembly as recited in claim 4, wherein the bottom metallic shell has an enclosing wall extending downwardly from the top wall, the enclosing wall sealing the second mounting slit to prevent leakage of electromagnetic noise therefrom.

6. The plug connector assembly as recited in claim 5, wherein the enclosing wall forms a fourth inserting groove cooperating with the second inserting groove to define a second hole along the front-to-back direction, the second cable extending through the second hole and connected with the PCB.

7. The plug connector assembly as recited in claim 1, wherein the connector comprises:

a base;

a tongue protruding upwardly from the base, the tongue having opposing front and rear connection faces;

a set of first contacts each having a contacting portion exposed on the front connection face and a tail portion connecting with the PCB; and a set of second contacts each having a contacting portion exposed on the rear connection face and a tail portion connecting with the PCB.

8. The plug connector assembly as recited in claim 7, wherein the base includes a body extending along a transverse direction and two wings extending downwardly from two lateral sides of the body, the tails of the contacts located between the two wings.

9. The plug connector assembly as recited in claim 8, wherein a locking protrusion is provided at the wing to lock with a locking hole disposed at the side wall.

10. The plug connector assembly as recited in claim 7, wherein the tongue extends upwardly beyond the top metallic shell.

11. A plug connector assembly comprising:

an electrical connector including an insulative base with a plurality of contacts extending in a first direction, each of said contacts having a front contacting portion exposed to an exterior in a second direction perpendicular to said first direction, and a rear tail portion;

a printed circuit board located behind the base in said first direction, mechanically and electrically connected to the rear tail portions of the contacts, and extending in a plane perpendicular to said second direction;

a cable mechanically and electrically connected to the printed circuit board and extending along said second direction; and a metallic shell essentially fully enclosing the printed circuit board while exposing a front mating portion of the connector, and including a first piece and a second piece assembled to each other in the first direction; wherein said shell forms an insertion hole extending in the first direction to receive weave layers of the cable in a fully circumferential manner, and a first part of said insertion hole is formed by the first piece while a remaining second part of said insertion hole is formed by the second piece.

12. The plug connector assembly as claimed in claim 11, wherein the first piece and the second piece are overlapped with each other in the second direction except at least the insertion hole.

13. The plug connector assembly as claimed in claim 11, further including an insulative case not only over-molded upon the shell but also the weave layers.

14. The plug connector assembly as claimed in claim 13, wherein said insulative case further occupies at least either a space between the shell and the printed circuit board or a hole in the connector to join with the connector.

15. The plug connector assembly as claimed in claim 11, wherein said insulative base is secured to the first piece of the shell, and the first piece is generally located between the insulative base and the second piece in said first direction.

16. The plug connector assembly as claimed in claim 11, wherein said second piece forms a mounting slit communicating with the second part of the insertion hole in the first direction.

17. A plug connector assembly comprising:

a metallic shell including opposite first piece and second piece assembled to each other in a first direction;

a printed circuit board disposed in the shell;

an electrical connector having a plurality of contacts mechanically and electrically connected to the printed circuit board and extending out of a first side of the shell along said first direction;

a cable mechanically and electrically connected to the printed circuit board and extending out of a second side of the shell along a second direction perpendicular to said first direction;

an insulative case enclosing said shell and a front end region of the cable; and said shell essentially fully circumferentially enclosing the printed circuit board and the connector except a front mating portion of said connector extending out of the shell in the first direction.

18. The plug connector assembly as claimed in claim 17, wherein weave layers of the cable is intimately received within an inserting hole formed by both said first piece and said second piece, and enclosed within the insulative case.

19. The plug connector assembly as claimed in claim 17, wherein said connector includes an insulative base in which the contacts are disposed and to which the first piece is secured.

* * * * *